United States Patent [19]

Böcker et al.

[11] Patent Number: 4,697,525

[45] Date of Patent: Oct. 6, 1987

[54] SUBCALIBER, ARMOR PIERCING PENETRATOR PROJECTILE

[75] Inventors: Jürgen Böcker, Oberhausen; Hans W. Luther, Kaarst; Peter Wallow, Düsseldorf; Horst Fritsch, Meerbusch, all of Fed. Rep. of Germany

[73] Assignee: Rheinmetall GmbH, Duesseldorf, Fed. Rep. of Germany

[21] Appl. No.: 917,634

[22] Filed: Oct. 10, 1986

Related U.S. Application Data

[63] Continuation-in-part of Ser. No. 476,408, Mar. 17, 1983.

[30] Foreign Application Priority Data

Mar. 17, 1982 [DE] Fed. Rep. of Germany ..... 3209593

[51] Int. Cl.[4] ..... F42B 11/06

[52] U.S. Cl. ..... 102/518; 102/521

[58] Field of Search ..... 102/501, 514–519, 102/520–521

[56] References Cited

U.S. PATENT DOCUMENTS

| | | | |
|---|---|---|---|
| 2,564,870 | 8/1951 | Weiss | 102/518 |
| 3,370,535 | 2/1968 | Permutter | 102/518 |
| 3,780,658 | 12/1973 | Longueville | 102/518 |
| 3,890,902 | 6/1975 | Travor et al. | 102/518 |
| 4,063,511 | 12/1977 | Bullard | 102/519 |
| 4,108,072 | 8/1978 | Trinks et al. | 102/518 |
| 4,353,302 | 10/1982 | Strandle | 102/518 |
| 4,649,829 | 3/1987 | Belsbury | 102/517 |

*Primary Examiner*—Harold J. Tudor

[57] ABSTRACT

An improved subcaliber fin-stabilized penetrator projectile of an equal diameter along its whole cylindrical length which is made of a high density, ductile, heavy metal. The herein described penetrator has a steel ballistic hood coaxially mounted on the front end thereof and a plurality of frontal cores mounted one behind the other in an axial direction behind said ballistic hood, and a main penetrator core arranged behind the frontal cores. Detachably connected to said ballistic hood and extending from said hood to the frontal region of the main penetrator core is a cylindrical casing of heavy metal having a smooth external surface and an outer diameter which is equal to the outer diameter of the main penetrator core. The plurality of frontal cores are partially mounted in said cylindrical casing, and partially in said ballistic hood. The main penetrator core of the projectile has a cylindrical front end extension of smaller diameter with which the casing is rigidly attached, a transition piece and a frustoconical stem. The frontal cores are equal in diameter and have an axially centered bore and a recess, and have rear faces and front faces. The ballistic hood is detachably mounted and holds a plurality of said frontal cores together against one another inside said casing in a play-free manner, with the frontal cores inner surfaces snugly fitted against the outside surface of the stem, and said cores outer surfaces snugly fitted against the inner surface of the said casing.

5 Claims, 3 Drawing Figures

SUBCALIBER, ARMOR PIERCING PENETRATOR PROJECTILE

PROSECUTION HISTORY OF PARENT APPLICATION

This is a continuation-in-part of application Ser. No. 476,408 filed Mar. 17, 1983 and entitled PENETRATOR SHELL WITH STACKED CORE ELEMENTS.

FIELD OF THE INVENTION

The present invention relates to an improved subcaliber fin-stabilized penetrator shell.

DESCRIPTION OF THE PRIOR ART

Such a projectile is described in allowed U.S. patent application Ser. No. 412,794, filed on Aug. 23, 1982 which is a continuation of application Ser. No. 949,067, filed on Sept. 5, 1978 now abandoned. The projectile in the above named application is very well suited for penetrating the laminated or compartment armor of a target with heavy armor, or, in the case of laminated armor with a very heavy outer layer under the same impact conditions, the penetration force is somewhat less than in the former case. In an application of the known projectile onto a slanted armor plate it was determined that the axis approximates the surface normal during the course of forming a penetration passage, as soon as the distance to the plate is shorter than the straight line distance to the plate edge and, therefore, forms an angle with the firing line (direction of firing). With the known projectile it was possible to avoid the premature breaking off of the main core through the arrangement of a number of frontal cores, however, it was not possible to avoid the deflection of the main core, particularly with very heavy outer layer armor. The above identified U.S. patent shows that a laterally effective force increases against the projectile during the projectiles ever further advance into the armor, whereby the danger of deflection from the desired flight path also increases.

SUMMARY OF THE INVENTION

The object of the present invention, therefore, is to improve the penetrator projectile to such a degree that it is suitable not only for laminated armor, but also for very heavy armor or laminated armor with very heavy armor interim plates. The deflection caused by the interaction between the projectile and the armor plate is to be avoided and thereby improve the penetration behavior of the main core, preferably equipped with sharp cutting edges.

BRIEF DESCRIPTION OF THE DRAWINGS

These and other objects and features of the invention will become apparent with reference to the following detailed specification and to the drawings wherein.

DETAILED SPECIFICATION

Figure 2:
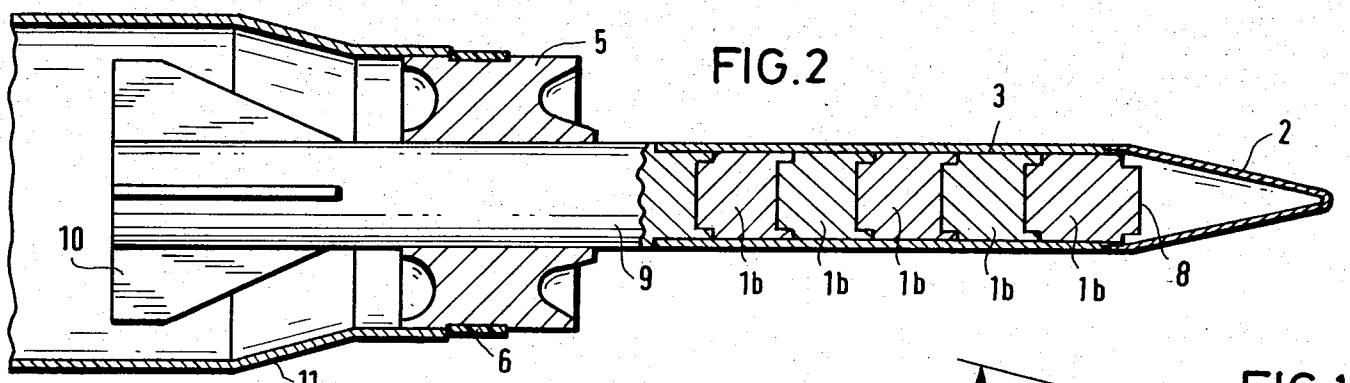
FIG. 2 shows the projectile according to U.S. patent application Ser. No. 949,067.

FIG. 2 shows the projectile comprising of a main core 9, the front core **1*b* as well as the ballistic hood 2. A casing 3 surrounds the front cores. The winged tail 10 is arranged on the rearward end of the main core 9. The main core is held by a sabot 5 with a rotating band 6. The sabot 5 is in turn held in the projectile casing 11. The front core 1*b* has a tenon 8** with a frontal cutting edge.

Figure 3:
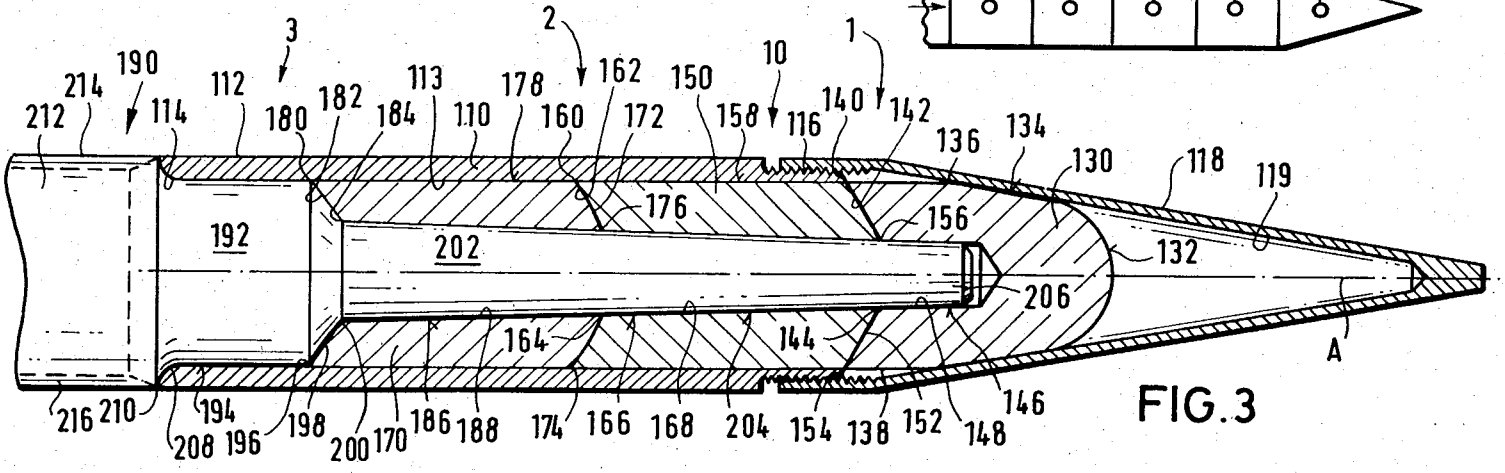
FIG. 3 shows an embodiment of the projectile in accordance with the present application as axial cross section of its frontal portion.

FIG. 3 shows a front penetrator part 10 having an axially rearwardly arranged main penetrator 190 and three front cores 130, 150 and 170 sequentially arranged along the longitudinal axis A of the penetrator. The frontally positioned front core element 130 with a part-spherical front surface 132 merges with a frustoconical surface 134 that flatly engages the inner surface 119 and that goes over at edge 136 to a cylindrical side surface 138. The latter extends to a circular outer edge 140 which circumferentially borders a frustoconical rear face 142. The frustoconical rear face 142 extends to a circular inner edge 144 of a centered recess 146 having a frustoconical and rearwardly flared inner surface 148. The frontally positioned front core element 130 is followed by a second front core element 150 with a frontal frustoconical face 152 which extends from a surrounding outer edge 154 to a frontal inner edge 156 of an axially centered throughgoing bore 166.

Figure 1:
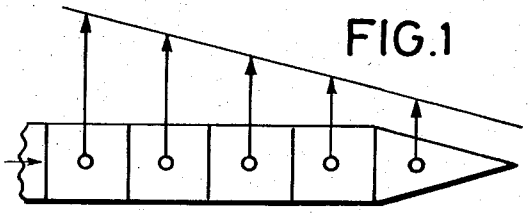
FIG. 1 shows a schematic illustration of the forces acting upon the projectile during a sloped approach to the target.

A cylindrical outer surface 158 extends from the front circular edge 154 to a rearward circular edge 160 which circumferentially borders a frustoconical rear surface 162. The latter extends to a rearward inner edge 164 of the bore 166 with an frustoconical inner surface 168. The second front core element 150 is followed by a third front core element 170 with front frustoconical face 172 which extends from a surrounding outer edge 174 to a frontal inner edge 176 of a bore 186 with an inner surface 188. The cylindrical side surface 178 is bordered at the front by the outer edge 174 and at the rear by the rear edge 180 where the surrounding surface 178 engages with a frustoconical rear surface 182 which extends to the rearward inner edge 184 of the bore 186. The third front core 170 engages with its rearward end with a front end extension 192 of the the main penetrator 190 showing a cylindrical side surface 194. The cylindrical side surface 194 is limited at the front by an outer edge 196 which engages with a circular truncated cone 198. An axially centered stem 202 with a outer surface 204 having an extreme front end 206 extends beyond the smaller diameter outer edge 200 of the cone 198. Rearwardly the outer surface 194 extends into a rounded section 208 to an outer circular edge 210 of a surrounding side surface 214 with a screw thread 216 of the main part 212 of the main penetrator body 190. The stem 202 fits snugly against the surfaces 186 and 166 of the two front cores 170 and 150 and extends with its extreme front end 206 into the recess 146 of the front core 130. The casing sleeve 110 and the ballistic hood 118, as in FIG. 1, are arranged so that the rear end surface 114 fits snugly with the rounded section 208 and the surrounding surface 112 is equal in outer diameter with the surface 214 of the main part 212.

When screwing the ballistic hood 118 onto the casing 110, the front cores 130 and 150, 150 and 170 will be axially pressed together against one another and the front core 170 will be prssed against the front end extension 192 in order to achieve movement free positioning at the fracture zones or planes 1, 2 and 3. In this manner the inner surfaces 188 and 168 of the bore 166, as well as the inner surface 148 of the recess 146 tightly enclose the stem 202.

After the breaking away of the ballistic hood 118, an essentially lumped interactive contact with good bite effect results between the front surface 132 and the armor plate during flat impact of the penetrator projectile onto a thick armor plate. Consequently, the front core 130 is deflected transversely to the longitudinal projectile axis A, and with the rear surface 142 effects an ever increasing pressure against the front face 152 of the subsequent front core. Further, after the breaking off of the stem along a junction plane in a fracture zone 1, an avertence of the remaining front penetrator 10 and its main core 212 results. However, during this avertence, the axial fixation of said penetrator, in relation to surface normal of the armor plate, remains warranted by way of the closely adjacently fitted surface formations in the fracture zones 2 and 3, as well as by the heavy metal casing 110. This process repeats itself during the penetration process.

The effect described above is essentially due to the conical formation of the stem 202. The deflection of the front core 130 with the breaking away of the stem 202 at the fracture zone 1 results in the avertence in the direction of the surface normal of the armor plate. During further penetration of the front penetrator into the target, the avertence of the remaining penetrator is achieved in that the stem 202, due to its now greater diameter, at first counteracts the pressure of the respective region of the frustoconical rear surface 162 on the front face 172 with greater resistance; allowing, then, after the breaking of the stem, for the full effect of the averting force. The process at the fracture zone 3 is analogous to the above process, such that the main penetrator 190 can now become fully effective against the target at a favorable angle.

The penetration capacity is improved in the above described process against very heavy single plate armor targets. With laminated armor said process is at least repeated at every heavy plate. Thereby the front cores of the front penetrator 10 can be made to correspond in number, in accordance with the materials used and the length of said cores, and thus also according to their respective masses, with the respective masses and number of each separate target plate.

Due to the deflection of each front core of the front penetrator 10, as described, an enlargement in the penetration opening of the respective target plate results over against the diameter of the penetrator. This proves to be beneficial for the subsequently following penetrator part—particularly with newly developed targets, i.e. with glass and/or ceramic module—in that it improves the passage through the respective plate and, therefore, improves its effect against subsequently arranged target plates.

The main core 212 and the front cores 130, 150, 170, as well as the casing 110, all consist of a ductile high density heavy metal. This may be, for example, a sintered alloy with approximately 90% to 98% tungsten, up to 3.5% nickel and up to 1.5% Fe and, if necessary, another 1% Co. Thereby, the large toughness, meaning the ductility, is achieved through the large percentages of Ni, Fe and Co. Moreover, the properties can be improved through a corresponding heat treatment after sintering. The ballistic hood consists of steel and shatters immediately upon impact with the initial armor. Depleted uranium can also be used instead of a tungsten alloy as ductile high density heavy metal. The density must be at least 18 g/cm$^3$.

While there has been described a particular embodiment of the invention, it will be apparent to those skilled in the art that variations may be made thereto without departing from the spirit and scope of the appended claims.

We claim:

1. An improved subcaliber fin-stabilized penetrator projectile of equal diameter along the whole length of its cylindrical shape and consisting of high density ductile heavy metal, selected from the group consisting of depleted uranium or a sintered alloy with high percentage of depleted uranium or tungsten, the latter in the range of 90–98%, which has a steel ballistic hood coaxially mounted on the front end thereof and a plurality of frontal cores mounted one behind the other in an axial direction behind said ballistic hood, and a main penetrator core arranged behind said frontal cores;

a cylindrical casing of said heavy metal having a smooth external surface being operatively detachably connected to said ballistic hood and extending from said hood to a frontal region of the main penetrator core and whose outer diameter is equal to the outer diameter of the main penetrator core, said plurality of frontal cores being operatively mounted partially in said cylindrical casing and partially in said ballistic hood, the improvement comprising in combination the main penetrator core having a cylindricl front end extension of smaller diameter with which the casing is rigidly attached;

a transition piece attached to said front end extension whose frustoconical surface is tapered towards its frontal portion;

a frustoconical stem tapered towards its frontal portion attached to said transition piece;

the frontal cores are equal in diameter and have an axially centered bore and recess corresponding with the diameter of the circumference of said stem;

the frontal cores having, on the rearward side, frustoconical rear faces each with a rearward opening frustoconical surface of equal slope;

said frontal cores, with the exception of the fore-most frontal core, as well as the transition piece on the front end extension of the main penetrator core, having the same slope on the front of each frustoconical surface of the front frustoconical face as on the frustoconical rear face;

the foremost core element having a part spherically formed front face;

the ballistic hood arranged near the fore-most frontal core being screwlike detachably mounted and holding a plurality of said frontal cores together against one another inside said casing in a play-free manner, with the frontal cores inner surfaces snugly fitted against the outside surface of the stem, and said cores outer surfaces snugly fitted against the inner surface of the said casing.

2. A projectile according to claim 1, wherein the fore-most positioned frontal core has a frustoconical surface on its front surface which abuts the inner sursface of the ballistic hood.

3. A projectile according to claim 2, wherein the rear faces and front faces have spherically rounded edge surfaces.

4. A projectile according to claim 3, wherein the front end extension of the main penetrator core is screw type detachably mounted to the main penetrator core.

5. A projectile according to claim 4, wherein the front end extension rearwardly has a rounded section which extends to a circular edge having the properties of a cutting edge.

* * * * *